United States Patent [19]

Lu

[11] Patent Number: 4,986,682

[45] Date of Patent: Jan. 22, 1991

[54] RETRACTABLE FINGER PEN

[76] Inventor: Shuenn-Chin Lu, 315 Min Tsu Rd., Tourfenn, Miaoli Hsien, Taiwan

[21] Appl. No.: 452,498

[22] Filed: Dec. 19, 1989

[51] Int. Cl.[5] ..... B43K 7/12; B43K 24/02

[52] U.S. Cl. ..... 401/7; 401/112

[58] Field of Search ..... 401/7, 103, 112, 99

[56] References Cited

U.S. PATENT DOCUMENTS

| | | | |
|---|---|---|---|
| 2,517,522 | 8/1950 | Zuber | 401/112 X |
| 3,947,132 | 3/1976 | Fox | 401/7 |

FOREIGN PATENT DOCUMENTS

| | | | |
|---|---|---|---|
| 2115649 | 10/1972 | Fed. Rep. of Germany | 401/7 |
| 69155 | 10/1958 | France | 401/112 |
| 781679 | 8/1957 | United Kingdom | 401/112 |

*Primary Examiner*—Steven A. Bratlie

*Attorney, Agent, or Firm*—Wenderoth, Lind & Ponack

[57] ABSTRACT

A fingertip-receiving pen includes a short hollow penholder for receiving a finger and a writing element coupled with a compression spring and attached to a socket within the penholder. The socket includes a unitary resilient hook member which can be forced to be seated in a hole extending through the side wall of the penholder so that the writing element can be firmly positioned when it is pushed by a finger to protrude beyond the front through-hole of the penholder. As soon as the resilient hook member is pressed to disengage the penholder from within the hole, the writing element is immediately pushed by the compression spring to completely move back inside the penholder so that the pen conveniently can be carried by oneself.

2 Claims, 2 Drawing Sheets

RETRACTABLE FINGER PEN

BACKGROUND OF THE INVENTION (a) Field of the Invention

The present invention relates to a fingertip-receiving pen and more particularly one which can be conveniently mounted on one finger of a user for writing.

(b) Description of the Prior Art

Conventional pens which are used as writing apparatus are generally comprised of an elongated handle or penholder into which a pen point is fitted. The inner refill cartridge of a pen may be a fixed type covered with a cap or a movable type mechanically propelled to protrude beyond or be received inside a penholder. Except for changes in design, the handles or penholders of the conventional pens do not vary and generally have an elongated rod-like structure convenient for being held by the hand.

SUMMARY OF THE INVENTION

The main object of the present invention is to provide a pen which can be mounted on a finger for writing conveniently so that its penholder can be greatly reduced in size.

Another object of the present invention is to provide a finger tip-receiving pen which is very practical for use by disabled persons who cannot hold the conventional writing apparatus for writing.

Still another object of the present invention is to provide finger tip-receiving pen in which a writing element is provided for writing and which can be conveniently controlled to protrude beyond or be completely received in a short penholder thereof.

Still, a further object of the present invention is to provide a fingertip-receiving pen in which the penholder can be made in any shape to make its outer appearance more attractive.

DETAILED DESCRIPTION OF THE PREFERRED EMBODIMENTS

Figure 1:
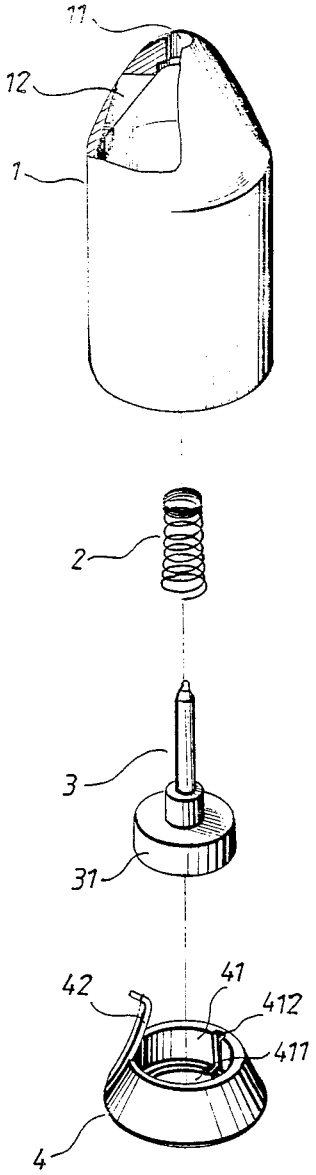
FIG. 1 is a perspective exploded view of a finger pen in accordance with the present invention.

Turning now to the annexed drawings and referring first to FIG. 1, a fingertip-receiving pen embodying the present invention generally comprises a penholder 1, an expansion spring 2, a writing element 3 and a socket 4.

The penholder 1 is a hollow rod about a fingertip in length and having a diameter suitable for the insertion therein of a fingertip, which defines a through-hole 11 extending axially through the center of the tip of the pen at its front conical end, and a hook-receiving hole 12 through the wall thereof.

The expansion spring 2 is mounted on the writing element 3 to provide the writing element 3 with a constant urging force.

The writing element 3, which is an inner reservoir accommodating the writing ink and has a ball point, is molded to have a stepped structure having a relatively larger stepped base 31 which has a small through-hole 32 penetrating through its central axis, and a shaft-like writing tip extending from base 31.

Figure 2:
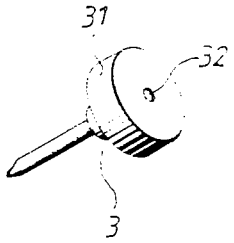
FIG. 2 is a perspective view of a writing element according to the present invention.

The socket 4 has a conical body defining a circular recess 41 for receiving the stepped base 31 of the writing element therein, a unitary resilient hook member 42 extending from the conical body and which resilient hook member 42 has its rear end turning upward and radially outward. A groove 411 is open to circular recess 41 and communicates therewith via a vertical groove 412 extending axially along an inner side-wall of the conical body. After the writing element 3 is attached to the socket, the through hole 32 of the writing element 3 (see FIG. 2) is maintained in open communication with the outside air through the grooves 411 and 412 of the socket 4 so that the ink in the writing element 3 is subjected to atmospheric pressure to facilitate smooth writing.

Figure 3:
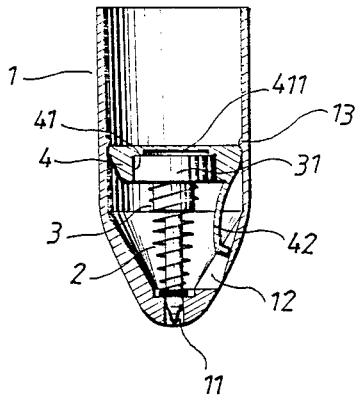
FIG. 3 is a sectional view of the finger pen of FIG. 1, showing a retracted position in which the writing element is completely received inside the penholder.
Figure 4:
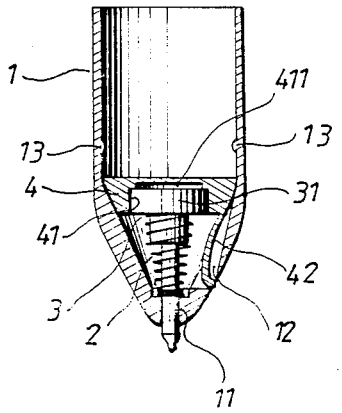
FIG. 4 is a sectional view of the finger pen of FIG. 1, showing a writing position in which the writing element is located at the exterior of the penholder for writing.
Figure 5:
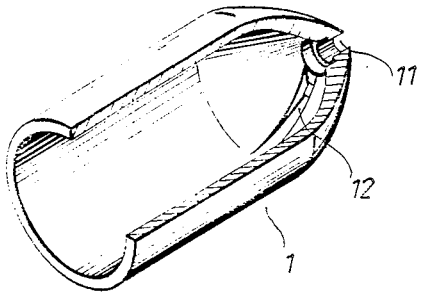
FIG. 5 is a partial sectional view of the penholder according to the present invention.
Figure 6:
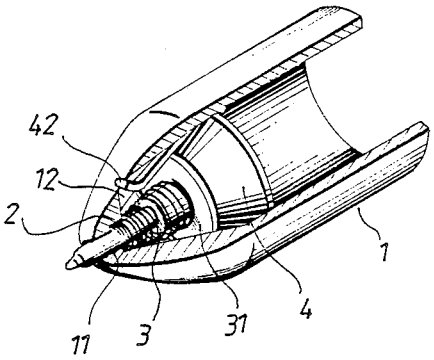
FIG. 6 is a partial sectional view of the finger pen of FIG. 1.
Figure 7:
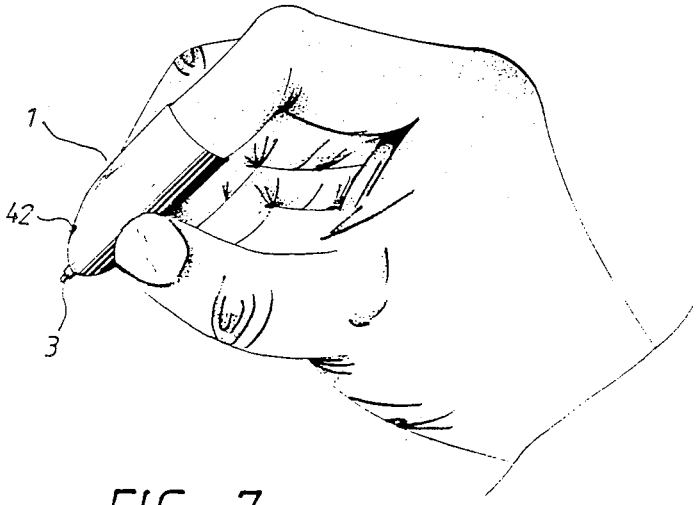
FIG. 7 is a schematic drawing, illustrating the use of the fingertip-receiving pen of FIG. 1 which is mounted on a finger of a hand.

The assembly of the said component parts is quite simple and is outlined hereinafter. After the compression spring 2 is mounted on the writing element 3 around the shaft-like writing tip thereof, the writing element 3 is, with its stepped base 31, inserted in the socket 4. The combination of the compression spring 2, the writing element 3 and the socket 4 is further inserted in the penholder 1 by force (see FIG. 5), permitting the socket 4 to be stopped by a raised portion 13 which is unitarily provided on the inner wall of the penholder 1 and extends radially inwardly therein (see FIG. 3). Through the effect of the compression spring 2 and the raised portion 13, the writing element 3 is completely received inside the penholder 1 conveniently so as to be able to be carried by oneself. When in use, one's fingertip may be inserted in the penholder 1 to push the socket 4 and the writing element 3 inward, permitting the resilient hook member 42 to engage the penholder within the hole 12 of the penholder 1. Therefore, the writing element 3 can be firmly positioned to protrude beyond the through-hole 11 for writing (see FIGS. 4 and 6). Because movement of the socket 4 is limited by the raised portion 13 and the seating of the resilient hook member 42 in the hole 12, the writing element 3 does not detach from the penholder 1.

As described above, because the total length of the finger pen can be reduced to one third or one fourth of the full length of the conventional writing apparatus, it is very convenient to be carried by oneself and yet can be used to write smoothly. More particularly, the present invention is very helpful to those disabled people who cannot hold the conventional writing apparatus. Any disabled person who has one finger that can be inserted in the penholder of the finger pen can very conveniently and efficiently use the present invention for writing smoothly.

In general, the structure of the present invention is mainly comprised of a hollow and relatively short penholder for receiving a fingertip therein. The writing element received in the penholder can be mechanically propelled. The writing element 3 and the socket 4 may be made as a unitary piece having a base stopped by the raised portion 13 of the penholder 1, and a resilient hook member (or raised ball-like portion) for engaging the penholder within the hole 12 of the penholder 1. The finger pen of the present invention may be molded in a variety of shapes, including conical, spherical, post-like, polygonal, animal figures or human characters. It is apparent that various modifications could be made to the present invention without departing from the basic teachings thereof.

What is claimed is:

1. A finger-tip receiving pen comprising:

a hollow penholder having an open read end, a front end tapering to a tip of the pen, a through-hole extending axially through the tip of the pen, a raised portion extending radially inwardly of the hollow penholder, and a hook-receiving hole extending through the hollow penholder at a location between the tip of the pen and said raised portion;

a writing element having a stepped body including a base and a shaft-like writing tip extending from said base, said base having a diameter larger than that of said shaft-like writing tip;

a socket disposed within said penholder and having a conical body defining a recess in one end thereof and a resilient hook member extending from said conical body to an end thereof that protrudes generally radially outward with respect to said hollow penholder, the base of said writing element disposed within the recess defined in the conical body of said socket; and a spring extending around said shaft-like writing tip and urging said socket and said writing element toward said raised portion, said socket slidable within said hollow penholder between a writing position at which the end said resilient hook member engages said penholder within said hook-receiving hole and said shaft-like writing tip extends through said through-hole to the exterior of said penholder against the urging force of said spring, and a retracted position at which the conical body of said socket abuts said raised portion under the urging force of said spring.

2. A finger tip-receiving pen as claimed in claim 1, wherein the base of said writing element accommodates a supply of ink therein and has a through-hole extending through an end thereof confronting the conical body of said socket, and said socket defines first and second grooves therein, said first groove open at the end of the base of said writing element such that the supply of ink is in open communication with said first groove, and said second groove extending axially in said conical body from said one end thereof and open to said recess and said first groove.

* * * * *